United States Patent [19]

Plone

[11] Patent Number: 5,035,320

[45] Date of Patent: Jul. 30, 1991

[54] DISPENSER SYSTEM WITH ELONGATED SELECTIVELY ACTIVATABLE DISPENSING PUSHER

[76] Inventor: Clifford Plone, 222 North Buena Vista, #101, Burbank, Calif. 91505

[21] Appl. No.: 520,276

[22] Filed: May 7, 1990

[51] Int. Cl.[5] ..... B65D 25/08

[52] U.S. Cl. ..... 206/219; 206/222; 220/521; 222/80; 426/112; 426/120

[58] Field of Search ..... 206/219, 221, 222; 220/521, 90.4; 222/80, 83; 229/103.1; 426/112, 115, 120, 124; 215/DIG 8

[56] References Cited

U.S. PATENT DOCUMENTS

| | | | |
|---|---|---|---|
| 2,487,236 | 11/1949 | Greensberg . | |
| 2,653,610 | 9/1953 | Smith . | |
| 2,653,611 | 9/1953 | Smith . | |
| 3,048,317 | 8/1967 | Cochrene | 229/103.1 |
| 3,225,915 | 12/1965 | Wise . | |
| 3,326,363 | 6/1967 | Bennett et al. . | |
| 3,524,566 | 8/1970 | Parks | 229/103.1 X |
| 3,539,794 | 11/1970 | Rauhut et al. . | |
| 3,743,520 | 7/1973 | Croner . | |
| 3,796,813 | 3/1974 | Kurland . | |
| 4,074,827 | 2/1978 | Labe, II | 206/217 X |
| 4,253,773 | 3/1981 | Aho et al. | 206/222 X |
| 4,264,007 | 4/1981 | Hunt | 206/219 |
| 4,333,583 | 6/1982 | Montemoreno | 220/90.4 |
| 4,387,809 | 6/1983 | Botzler | 206/219 X |
| 4,399,158 | 8/1983 | Bardsley et al. | 426/112 |
| 4,524,078 | 6/1985 | Bardsley et al. | 426/112 |
| 4,596,713 | 6/1986 | Burdette | 426/107 |
| 4,627,986 | 12/1986 | Bardsley et al. | 206/219 X |
| 4,634,003 | 1/1987 | Veda et al. | 206/221 |
| 4,785,931 | 11/1988 | Weir et al. | 206/222 |
| 4,821,875 | 4/1989 | Groves et al. | 206/219 |

*Primary Examiner*—Bryon P. Gehman
*Attorney, Agent, or Firm*—William W. Haefliger

[57] ABSTRACT

A dispenser for dispensing dispensable substance or substances comprising carrier structure; elongated pusher structure on the carrier structure; elongated receptacle structure beneath the pusher structure and on the carrier structure, there being an elongated zone or zones between the pusher structure and receptacle structure to receive the dispensable substance or substances; the pusher structure being selectively manually deflectable toward the receptacle structure, at selected locations along the length of the pusher structure length; the receptacle structure being frangible at selected lengthwise locations corresponding to the selected locations along the length of the pusher structure, and in response to deflection of the pusher structure; whereby dispensing of the dispensable substance or substances occurs at related lengthwise locations of the receptacle structure; the pusher structure, including at least one pusher having length which is at least about three times its width, and having arching extent over its width so as to project upwardly from the carrier structure, and including a deflector integral with such arching extent to project downwardly in the arching extend toward the receptacle structure, along the elongated length of the pusher, whereby a user can progressively run his finger lengthwise along the pusher to deflect the pusher to an extent corresponding to the amount of dispensable substnce to be dispensed from the receptacle structure in response to deflector engagement with and opening of the receptacle structure.

24 Claims, 8 Drawing Sheets

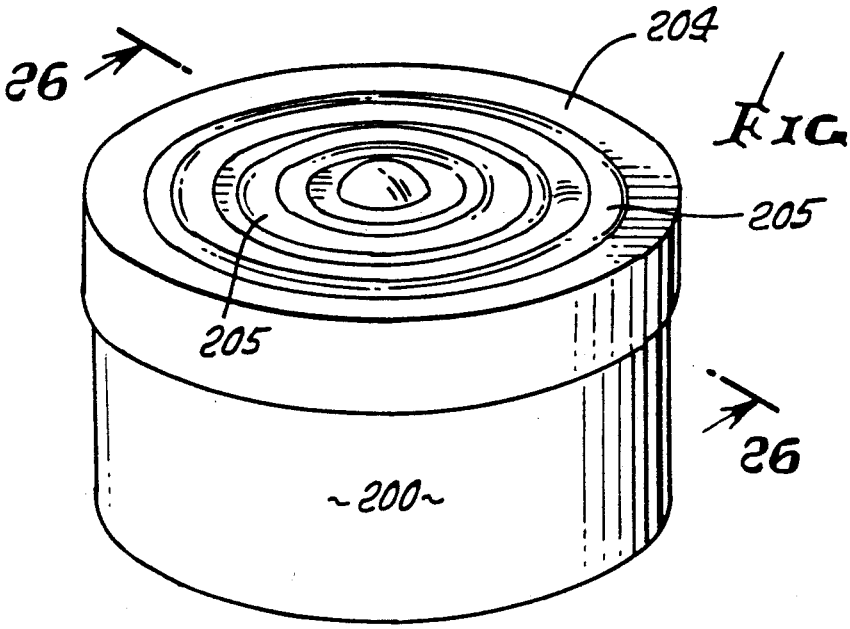
FIG. 25.
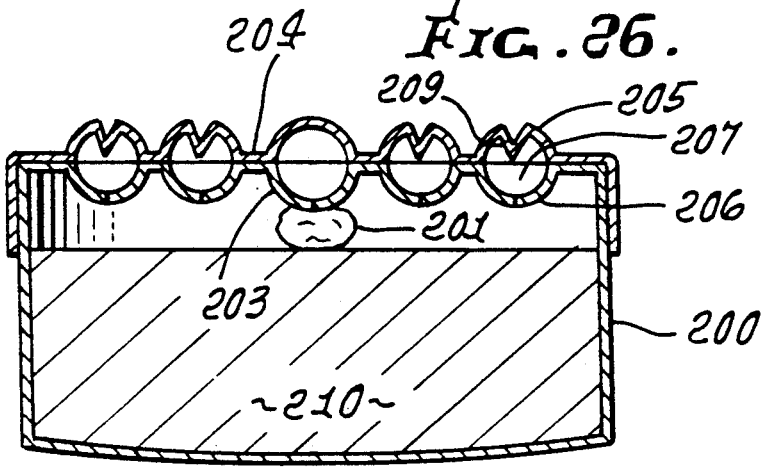
FIG. 26.
FIG. 27.
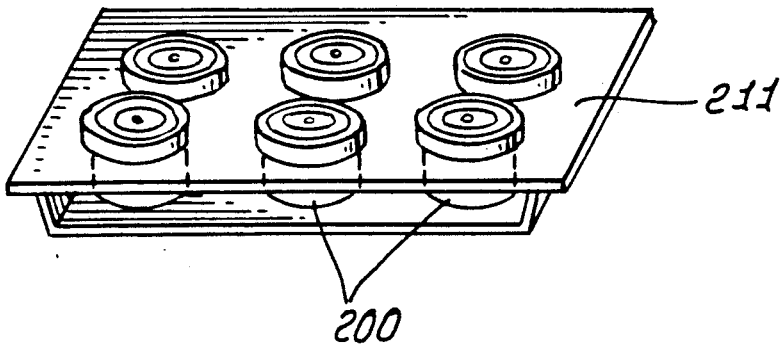

DISPENSER SYSTEM WITH ELONGATED SELECTIVELY ACTIVATABLE DISPENSING PUSHER

BACKGROUND OF THE INVENTION

This invention relates generally to dispensers for dispensing flowable or liquid substances onto other substances in cups or trays; and more particularly concerns simple, effective, manually manipulable dispensers for such flowable or liquid substances retained on tops or caps on such cups or trays.

The packaging or handling of foods, and their containers, at fast food restaurants or the like presents continual problems. For example, customers are handed coffee in cups with caps but must remove the cap to pour in sugar or cream at other locations. Similarly, customers are handed salad in plastic trays with tops, or covers, which must be removed and thrown away in order to pour salad dressing, or salad oil, or mayonnaise onto the salad from different containers for such substance at other locations. There is need for means or systems that will reduce these steps, and eliminate the handling by different persons of dispensing containers for sugar, cream, different dressings, etc., which can create confusion, mess, and unsanitary conditions, and delays.

SUMMARY OF THE INVENTION

It is a major object of the invention to provide system and method for dispensing various substances that will eliminate these problems and difficulties. Basically, the invention is embodied in a dispenser that includes:

a) carrier means,
b) elongated pusher means on the carrier means,
c) elongated receptacle means beneath the pusher means and on the carrier means, there being an elongated zone or zones between the pusher means and receptacle means to receive dispensable substance or substances,
d) the pusher means being selectively manually deflectable toward the receptacle, at selected locations along pusher means length,
e) the receptacle means being frangible at selected lengthwise locations corresponding to the selected pusher means locations, and in response to deflection of the pusher means,
f) whereby dispensing of dispensable substance or substances occurs at locations corresponding to selected deflected locations of the pusher means.

As is clear, the invention enables quick, efficient, hygienic, selective dispensing of multiple substances onto food, and different selected amounts of such substances, thereby eliminating the mess, delay, and confusion associated with prior systems.

It is a further object to provide such dispenser means on a carrier in the form of a lid for a container, such as a cap or tray; and further to provide the pusher to extend arcuately or linearly on the lid to enable finger movement along the pusher for selective dispensing of different amounts of dispensable substance.

Yet another object is to provide the pusher on a first carrier, and the receptacle on a second carrier, the two carriers interfitting to form a lid. The lid may also define a drinking zone, which may be selectively opened near the pusher or pushers. In this regard, the drinking zone may be near the side of the lid, or may rise as a dome offset from the lid center, or at the lid center, and the pusher may also be associated with, or built into, the dome on the lid.

It is yet another object to provide substances, such as cream, sugar, salad dressing, mustard, mayonnaise, ice cream topping, etc., in different receptacles to be variably dispensed when pushers are selectively pushed downward, as along their lengths, as will appear.

These and other objects and advantages of the invention, as well as the details of an illustrative embodiment, will be more fully understood from the following specification and drawings, in which:

DRAWING DESCRIPTION

Figure 1:
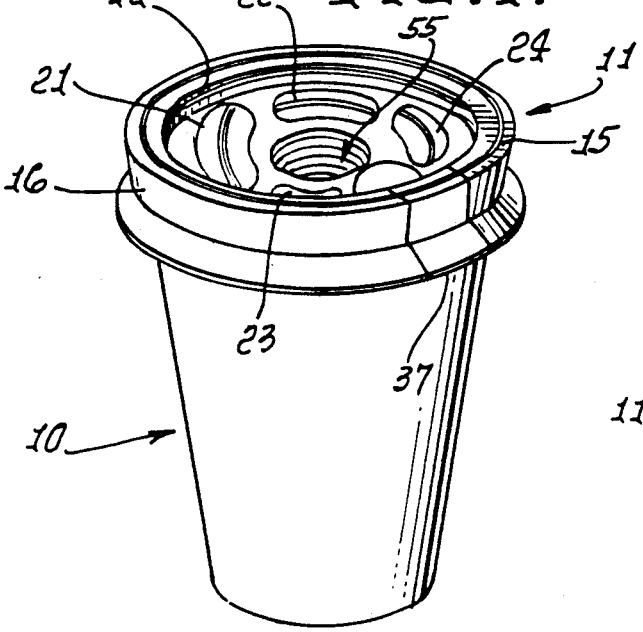
FIG. 1 is a perspective view of a dispenser top or cap on an associated drinking cup.
Figure 7:
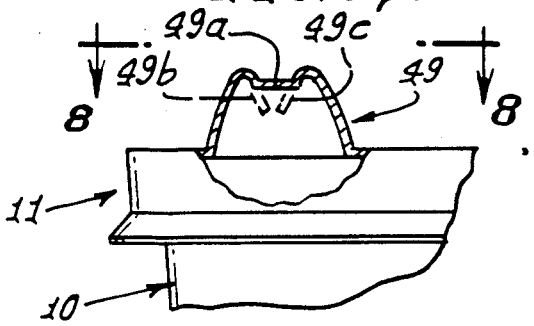
FIG. 7 is a fragmentary view of a modified drinking means on the FIG. 1 dispenser top.
Figure 2:
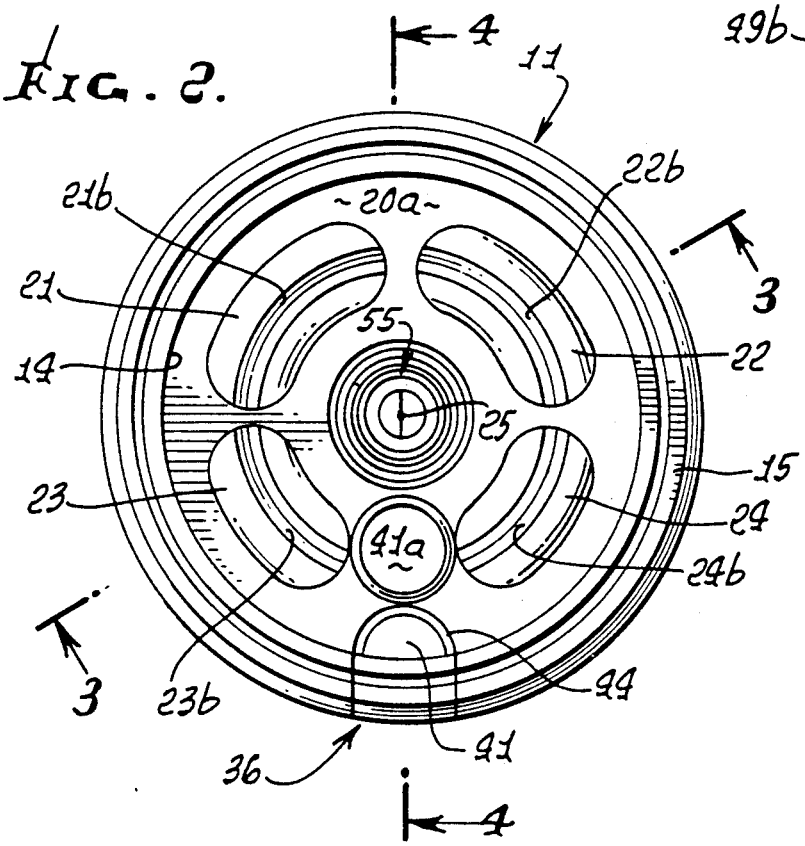
FIG. 2 is a plan view of the FIG. 1 dispenser top.
Figure 6:
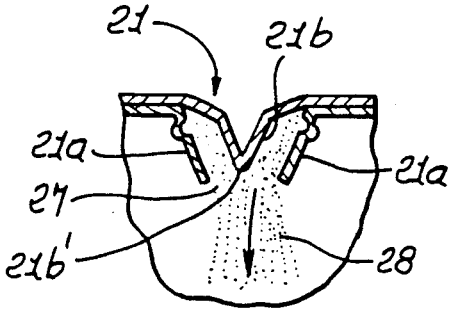
FIG. 6 is a fragmentary view showing pusher and receptacle means on the top in downwardly displaced condition.
Figure 12:
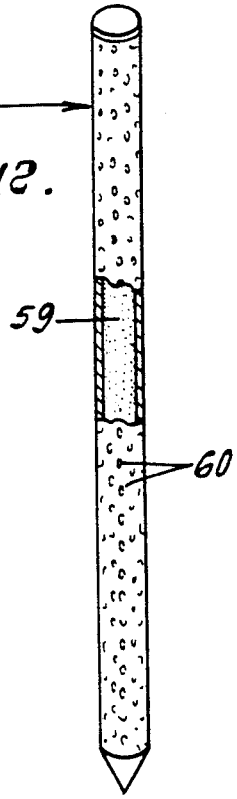
FIG. 12 is a perspective view of a mixing tube which contains substance to be dispensed into the cup.
Figure 14:
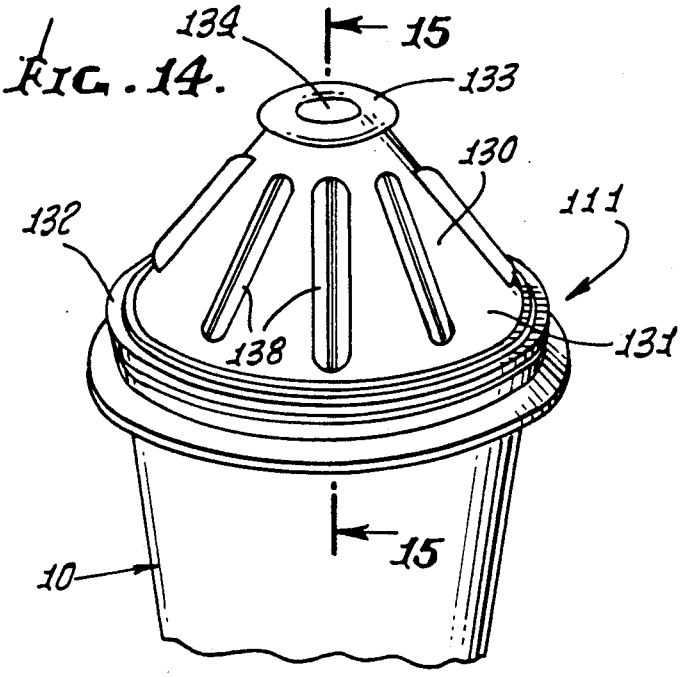
Figure 16:
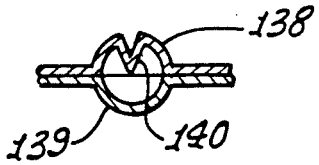
Figure 17:
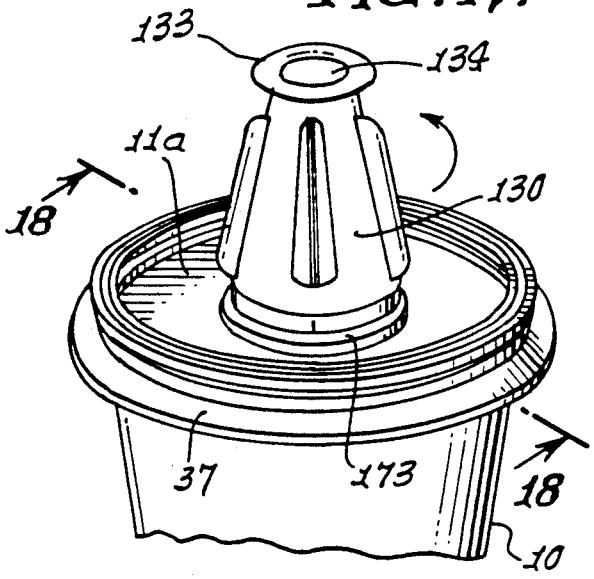
Figure 15:
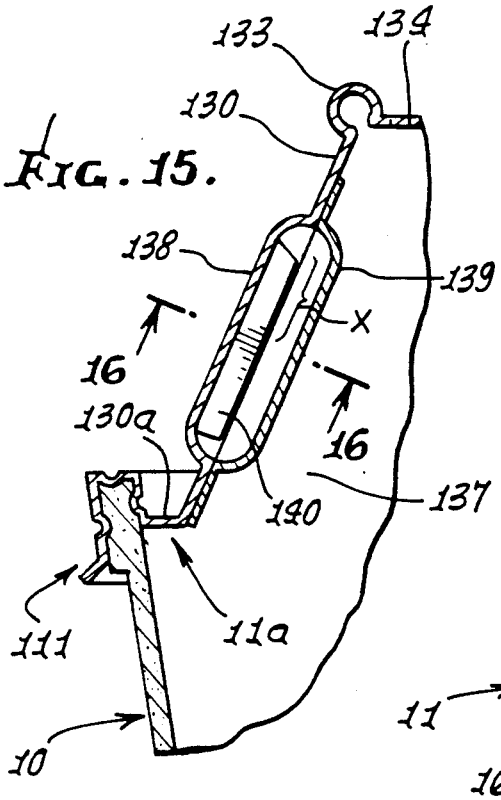
Figure 13:
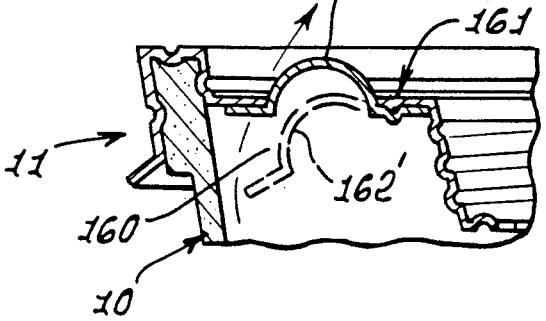
Figure 18:
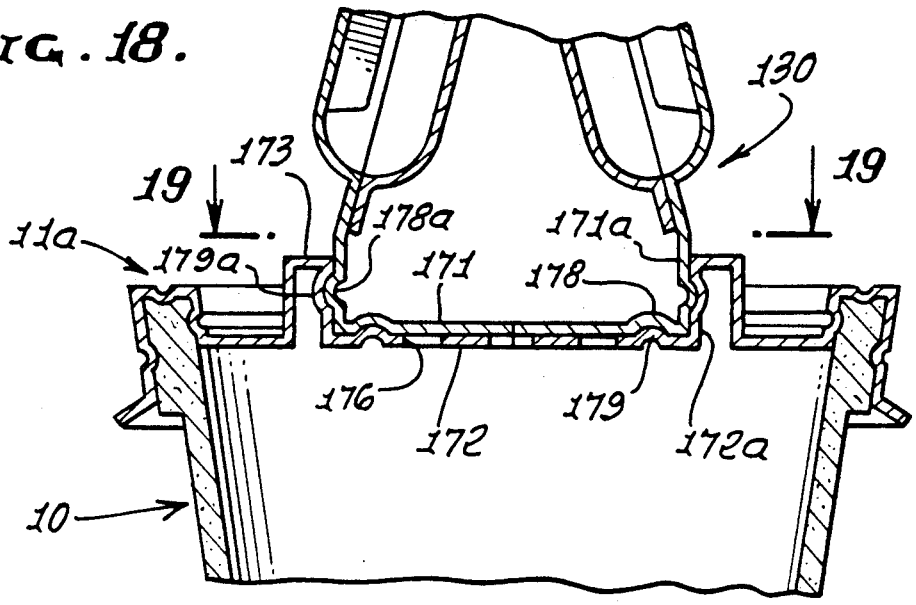
Figure 19:
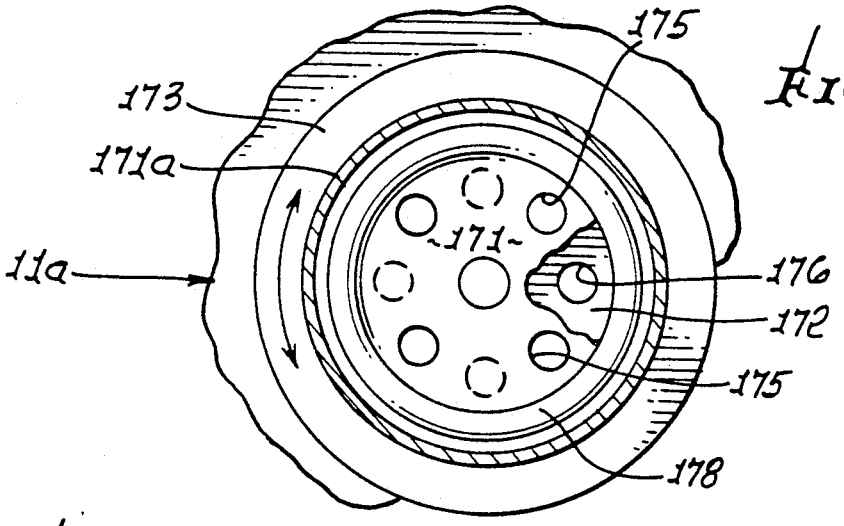
Figure 20:
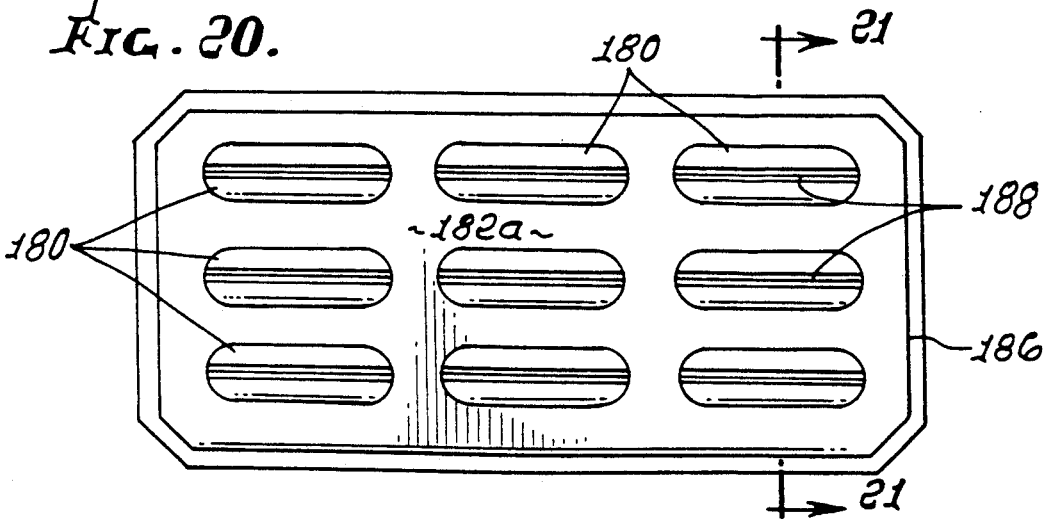
Figure 21:
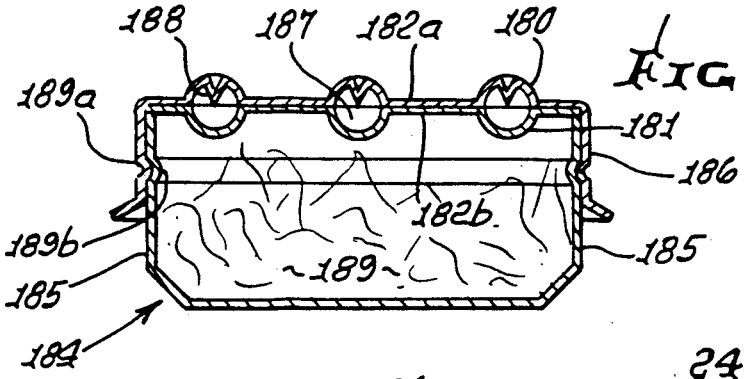
Figure 22:
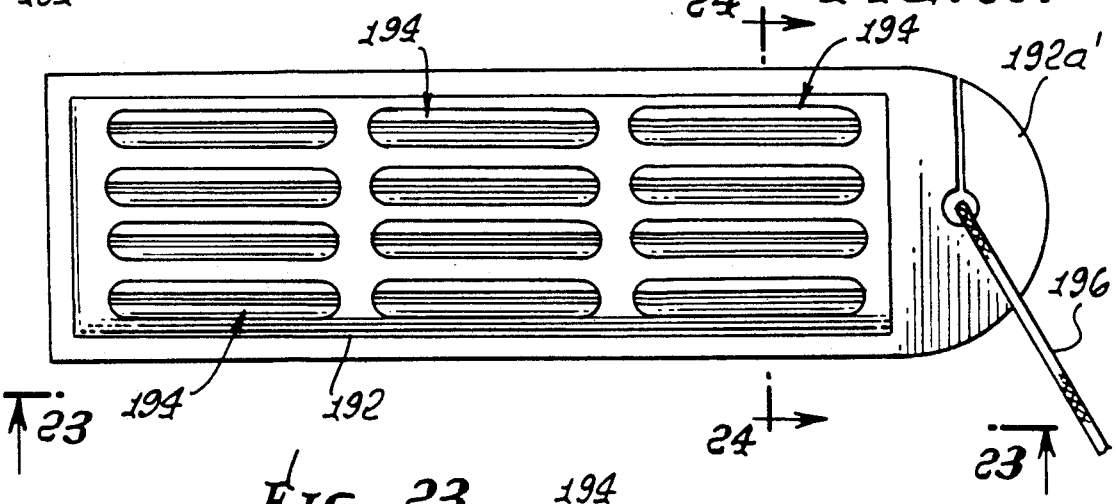
Figure 23:
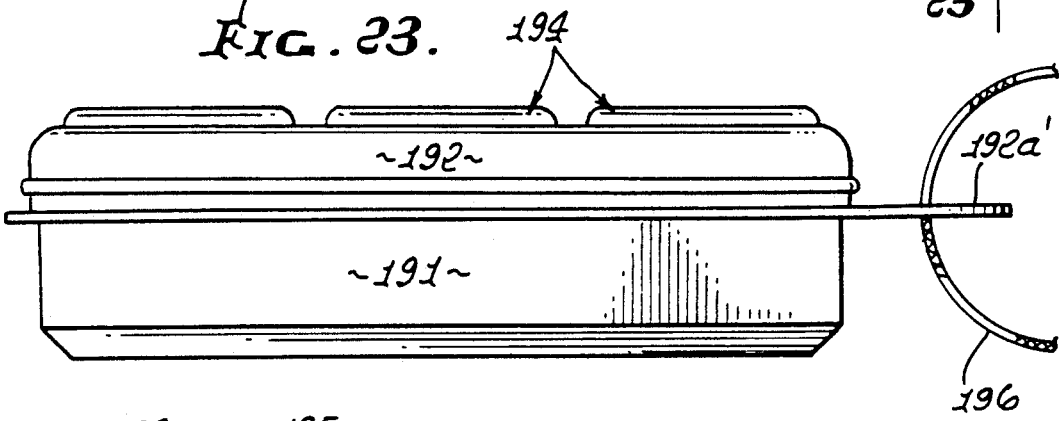
Figure 24:
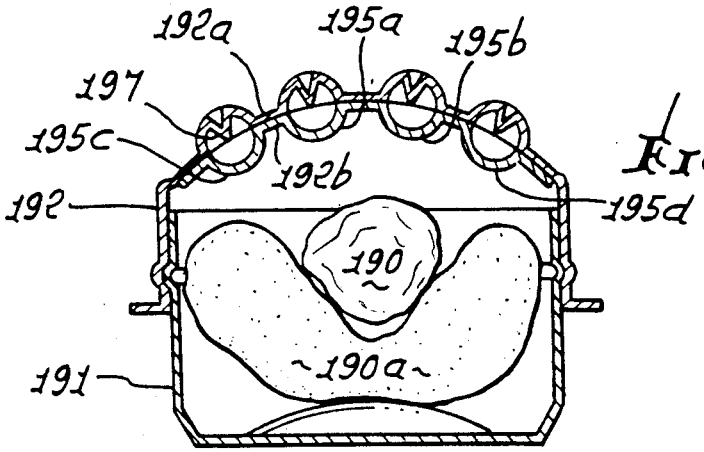
Figure 28:
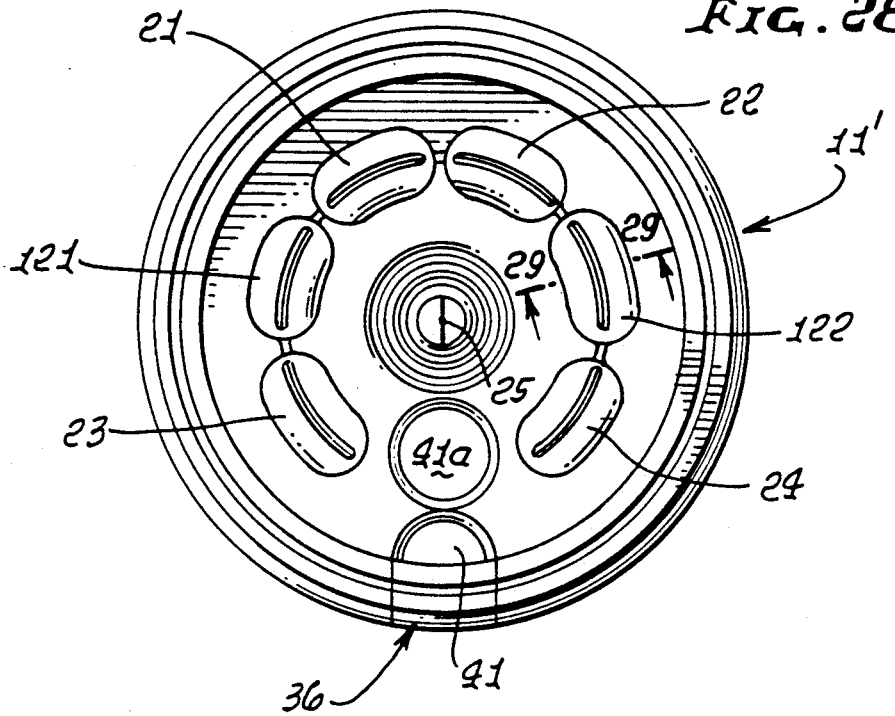
Figure 29:
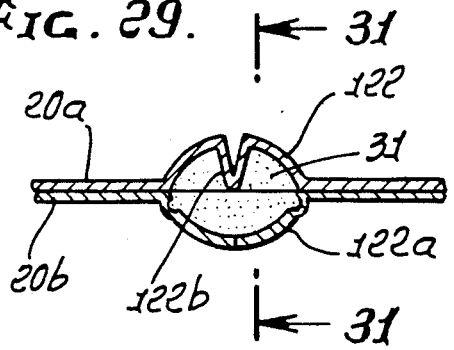
Figure 30:
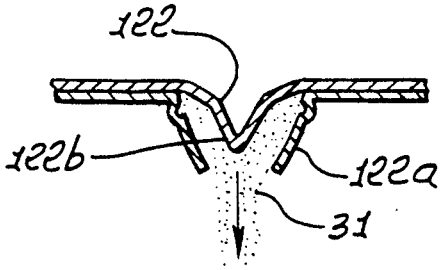
Figure 31:
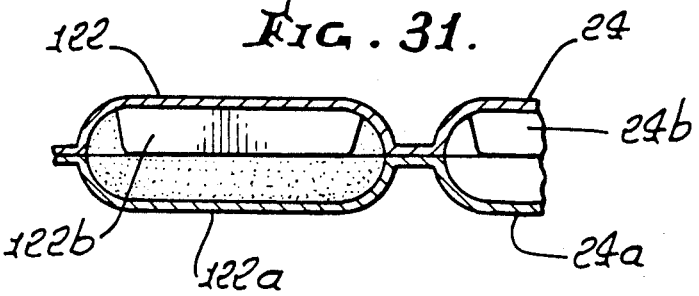

FIG. **12*a* is a view like FIG. 12** showing a modification;

FIG. 13 is a view like FIG. 7 showing a modified drinking means on a dispenser top;

FIG. 14 is a view like FIG. 1 showing a modified dispenser top or cap on a drinking cup;

FIG. 15 is an enlarged section taken in elevation on lines 15—15 of FIG. 14;

FIG. 16 is a section taken on lines 16—16 of FIG. 15;

FIG. 17 is a view like that of FIG. 14 showing yet another modified dispenser top or cap with a central drinking means on a drinking cup;

FIG. 18 is an enlarged section taken on lines 18—18 of FIG. 17;

FIG. 19 is a horizontal section taken on lines 19—19 of FIG. 18;

FIG. 20 is a plan view of a further modified dispenser cap or top, as for use on a tray;

FIG. 21 is a section taken in elevation on lines 21—21 of FIG. 20 showing the dispenser above salad in a tray;

FIG. 22 is a plan view like FIG. 20 showing a modified dispenser above a wiener and bun in a tray;

FIG. 23 is a side view elevation taken on lines 23—23 of FIG. 22;

FIG. 24 is a sectional elevation taken on lines 24—24 of FIG. 22;

FIG. 25 is a view like FIG. 1 showing an additional modified cap or top on an ice cream container;

FIG. 26 is an elevation taken in section on lines 26—26 of FIG. 25;

FIG. 27 is a perspective view showing multiple of the containers, and their tops, as in FIG. 25, on a support;

FIG. 28 is a view like FIG. 2 showing yet another modification;

FIG. 29 is an enlarged section taken on lines 29—29 of FIG. 28;

FIG. 30 is a view like FIG. 6 showing the FIG. 29 receptacle in downwardly opened position; and FIG. 31 is a section taken along the length of a succession of pushers and receptacles of the type seen in FIG. 28.

DETAILED DESCRIPTION

In FIGS. 1-6, a drinking cup 10 is provided with a carrier in the form of a cap 11. The cap or lid includes an outer portion 11*a* that interfits the upper rim portion 10*a* of the cup, which may for example consist of molded plastic material, such as styrofoam. Note that lid outer portion 11*a* may have an inner annular wall 14 that extends upwardly adjacent the cup inner wall 13, a top wall 15 that extends over the cup rim, and an outer wall 16 that extends downwardly adjacent the cup rim outer wall 17. Detented portions of these lid walls may interfit correspondingly detented portions of the cup wall, as at 18 and 19, for example, to form a rim seal.

The lid or cap also includes pusher means on the disc portion or wall 20 as well as receptacle means on that wall 20. See for example the multiple, arcuately elongated pushers 21, 22, 23, and 24 which extend upwardly and about the upright axis 25, and the corresponding multiple, arcuately elongated, receptacles 21*a*, 22*a*, 23*a*, and 24*a* which extend downwardly and about axis 25 directly beneath the pushers. The pushers are integral with an upper layer 20*a* of the wall 20, and the receptacles are integral with a lower layer 20*b* of the wall 20, the two layers typically being separately molded of plastic material and bonded together at their interface. Deflectors 21*b*-24*b* are respectively carried by, and are integral with, the pushers to project downwardly toward the receptacles to deflect and open the receptacles when the pushers are selectively pushed or displaced downwardly. See for example FIG. 6 showing a flexible pusher 21 displaced downwardly (manually) to cause a deflector 21*b* to split open, at 27, a thin walled, frangible receptacle 21*a* so that the contents 28 of the receptacle can drain or fall into the liquid in the cup 10. Different receptacles contain different additives (for the liquid), such as sugar and cream (or other), to be added to coffee or tea (or other) in the cup. See sugar at 30 and cream at 31 in FIG. 3.

Each pusher and its receptacle define an interior zone, as at 32, separated from the interior zone of other pushers and their receptacles. Further, each pusher and its receptacle are arcuately elongated so that the user can run his finger along the pusher to desired extent corresponding to the amount of additive to be added into the liquid in the cup. This is particularly effective in the case of sugar, which tends to fall primarily from that portion of the receptacle which is split open by the deflector. The latter tapers downwardly toward an edge tip as at 21*b*', and which variably splits open the receptacle to the extent that the user's finger is pushed downwardly directly over that deflector. Note that pushers 21 and 22 may extend over zones which contain cream, and pushers 23 and 24 may extend over sugar-containing zones. Thus, the receptacle means, being frangible, is pushed open at selected lengthwise locations that correspond to the selected deflected pusher means locations, and in response to local deflection of the pusher means.

Note also the provision of a zone on the lid adapted to be opened to define a drinking access means, for passing liquid from the container interior through the lid on the container. See for example the local flap zone 36 of the lid in FIGS. 4 and 5. As the local lip 37 of the liftable flap is raised, it lifts local wall sections 38-40 of the lid, as well as local cover section 41 of the lid, to the position seen in FIG. 5, exposing opening 42 via which the liquid contents of the cup may be poured, or drunk, as the cup is tilted. See also the local angled portion 44 of the lid which allows flexing at that portion as the flap is raised. That flap is located between pushers 23 and 24 in FIG. 2. Cover section 41 is displaced over cover section 41*a* in FIG. 5.

Figure 8:
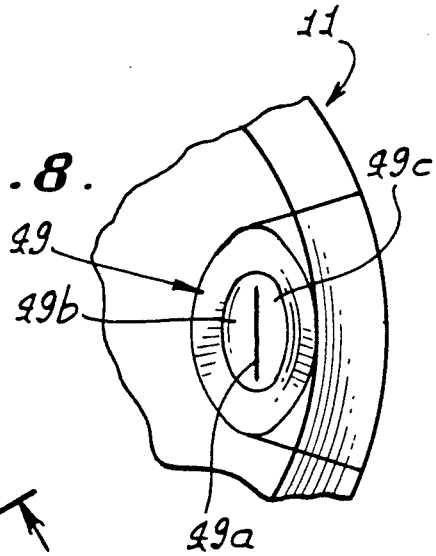
FIG. 8 is a plan view taken on lines 8—8 of FIG. 7.

A modified drinking access zone is shown in FIGS. 7 and 8 to comprise a local dome section 49 of the lid, as between pushers 23 and 24, and near the cup outer wall. The top of the dome defines a slit 49*a* via which liquid may be poured or drunk, after push down of dome sections 49*b* and 49*c*.

Figure 3:
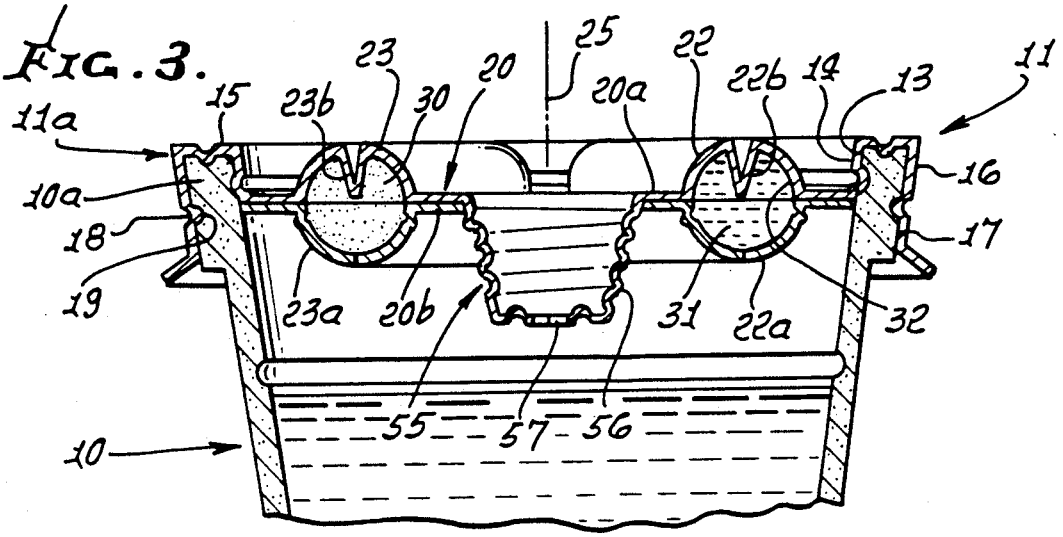
FIG. 3 is a section taken on lines 3—3 of FIG. 2.
Figure 4:
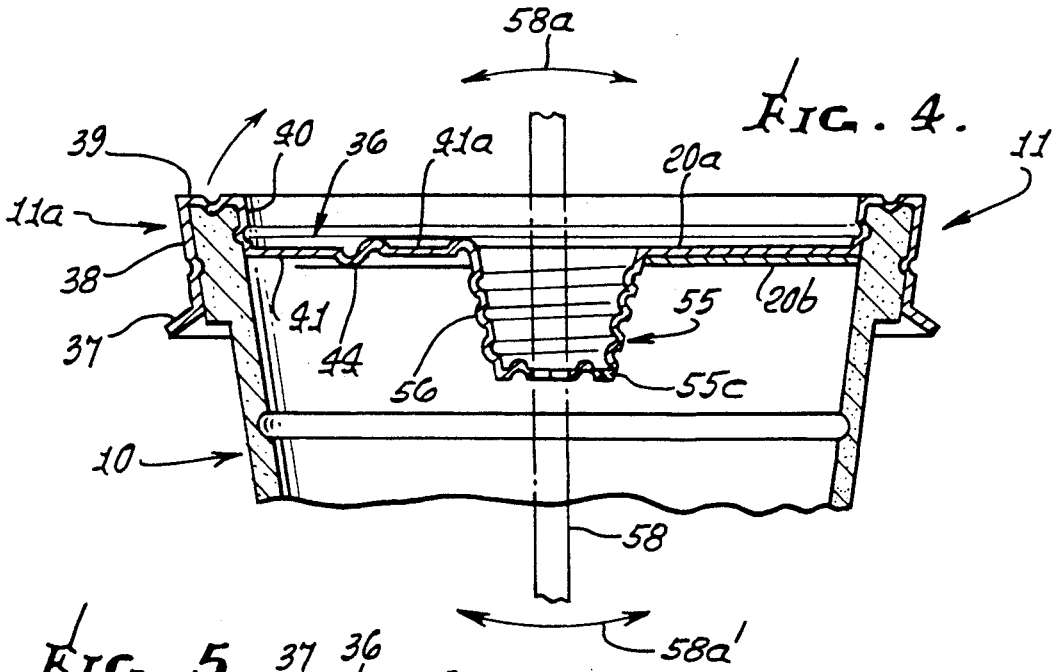
FIG. 4 is a section taken on lines 4—4 of FIG. 2.

FIGS. 3 and 4 show a central portion of the lid which forms a flexible receptacle 55 projecting downwardly, and having an undulating wall 56. It contains a central opening 57 to pass a mixing stick or rod at 58.

The latter may then be oscillated, manually (see arrows 58*a* and 58*a*') due to the flexing wall 56 for mixing of liquid and additives in the container.

In FIG. 12, the mixing stick 58*b* is tubular and contains substance 59 to be dispensed into liquid in the container 10, as via pores or openings 60 in the tube wall. Tea may, for example, be dispensed into hot water in the container, via water ingress into the stick, and tea-flavored water egress.

Figure 9:
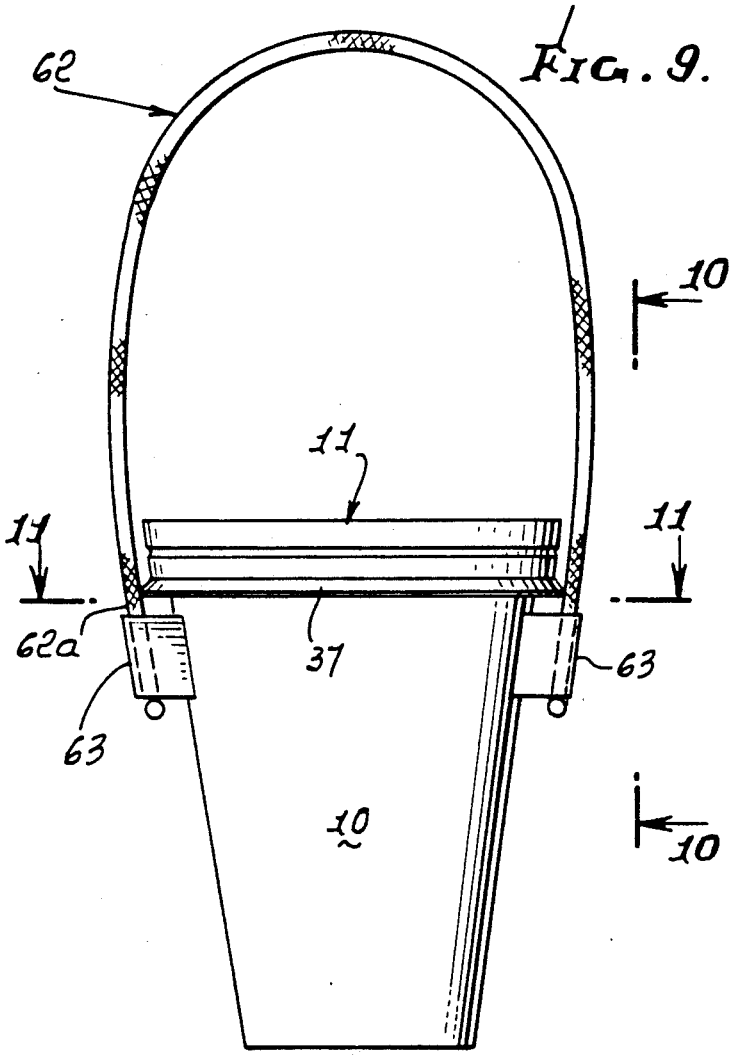
FIG. 9 is an elevation showing a handle on the cup as shown in FIG. 1.
Figure 10:
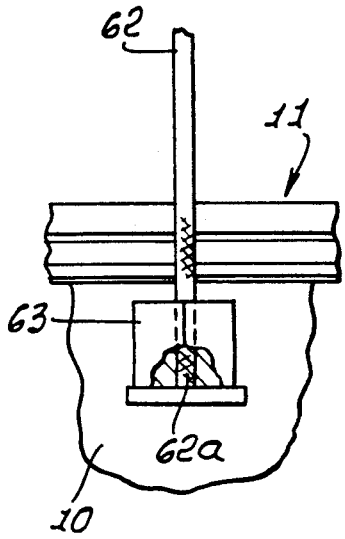
FIG. 10 is a fragmentary elevation taken on lines 10—10 of FIG. 9.
Figure 11:
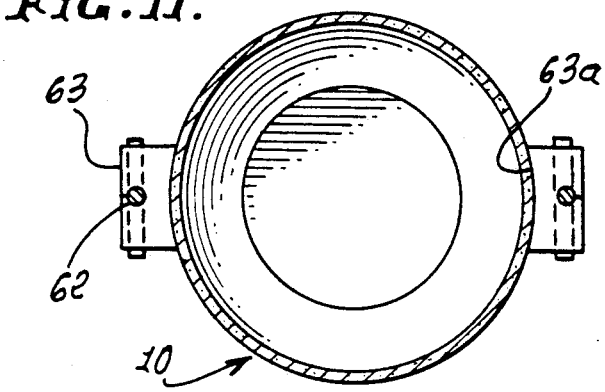
FIG. 11 is a section taken on lines 11—11 of FIG. 9.

FIGS. 9-11 show the apparatus as described, as in FIGS. 1-8, but wherein a flexible U-shaped handle 62 is provided. Lower ends 62*a* of the handle fit in ears 63 on the wall of the cup or container 10. Those ears may be tapered at 63*a* to fit the cup without being integral therewith.

In FIGS. 14-16, the carrier or lid 111 for the cup or container s modified and has a central dome portion 130 which tapers upwardly from a region 131 near the annular bead 132 which attaches to the container rim as before. See FIG. 3. The thin-walled dome is frusto-conical and has an annular top 133 like a soft drink bottle top centrally open at 134 for drinking purposes, as when the cup 10 is tilted. The slanting wall of the dome carries or supports pushers 138, and associated receptacles 139 of the same elongated construction as before, except that they are upright and linear, rather than horizontally curved. The dome is hollow, as seen at 137 in FIG. 15, whereby the contents of the receptacles are selectively discharged into that hollow to fall into liquid in the container when the pushers are pushed inwardly toward the hollow. Such pushing causes the deflectors 140 to open up the frangible receptacles and discharge their contents via the opened up slit cut by the deflector. If only that upper portion of the deflector indicated at "x" in FIG. 15 cuts into and opens a deflector, then only that much of the receptacle contents spills into the container, whereby the amount of used sugar, cream, etc., may be accurately controlled. The pushers are on lid or cap wall section 130*a*, integral with conical wall 130, and the receptacles are on section 130*b* attached to 130. Section 130*a* joins lid outer portion 11*a*.

FIG. 13 shows a modified drinking access opening 160 provided in the lid 161 when a tab 162 is pushed downwardly to position 162'. The lid is of the form seen in FIGS. 1-8.

FIGS. 17 and 18 show another modified form, similar to FIGS. 14 and 15, but wherein the carrier includes additional upper and lower carrier sheets extending horizontally in adjacent relation to form the lid, one additional carrier sheet carrying the dome portion of the carrier, and the other additional carrier sheet connectible to the container, the sheets having registrable openings therein, and the upper additional sheet rotatable relative to the lower dditional sheet to selectively register the openings. See for example in FIG. 18 the additional and rotary upper carrier sheet 171, and the additional and non-rotary lower carrier sheet 172, extending horizontally in superposed relation. Sheet 171 carries the dome portion 130, as described above, as via upright annular peripheral wall 171*a* connected to or integral with wall 130*a*; and the lower carrier sheet 172 has an upright annular wall 172*a* joined at 173 to the lid outer portion 11*a*. Upright wall 172*a* rotatably centers the upright wall 171*a* as the latter is rotated. Such rotation, effected manually by rotating the dome 130, brings openings 175 in upper carrier sheet 171 into vertical registration with openings 176 in the lower carrier sheet 172 for passing the substances selectively discharged into the central hollow 137, as by manipulation of the pusher or pushers. Note also the top 133, open at 134, for drinking. Note guide ribs 178 and 179, which annularly nest, and ribs 178*a* and 179*a* which nest and retain the wall 171 adjacent wall 172.

FIGS. 20 and 21 show a cluster of linear, elongated pushers 180 above corresponding receptacle 181. There are three rows of pushers and receptacles, each row including three pushers. Lid upper section 182*a* supports the pushers, and lid lower section 182*b* supports the receptacles. A container 184 is elongated and in the form of a tray having upright walls 185. Section 182*b* seats on the upper rim of the walls; and section 182*a* has a skirt 186 that fits down over and adjacent the walls 185. Salad 189 is received in the tray, and the receptacles and pushers form zones 187 for liquid salad dressing or different dressings. Deflectors 188 are carried by the pushers and function in the same manner as described in respect of FIGS. 1–8. One may therefore dispense selected salad dressing on selected portions of the salad by operation of the pushers, each of which is selectively operable along its length, so that only the selected amount of dressing is dispensed. Note tray and lid detents at 189*a* and 189*b*.

FIGS. 22–24 show the same arrangement as in FIGS. 20 and 21 except that the food in the transparent plastic tray 191 comprises a frankfurter (hot dog) 190 in an open bun 190*a*. The lid sections 192*a* and 192*b* are arched, as shown, and there are three rows of pushers 194 and receptacles 195, for example to contain mustard, in the row of receptacles 195*a*, catsup in receptacles 195*b*, pickle relish in receptacles 195*c*, and other substances, as for example minced onions, in receptacles 195*d*. A cord 196 is attached to an end extension 192*a*' of the lid 192 for transporting the closed assembly. The carrier or lid 192 is removable off the tray 191, after dispensing the substances from the receptacles by operation of the pushers to enable removal of the bun or frankfurter for consumption. Deflectors appear at 197.

FIGS. 25 and 26 are like FIGS. 20 and 21 except that the food in the container 200 comprises ice cream at 210. Note the cherry 201 positioned at the top center of the frozen ice cream, as by a downward bulge 203 on the cover 204. The latter carries elongated pushers 205 and receptacles 206 that extend circularly on the cover, and define zones 207 for reception of toppings, as desired (chocolate sauce, etc.). Note deflectors 209 carried by the pushers.

In FIG. 27, a flat tray 211 supports multiple of the containers 200, as described.

In FIGS. 28–31, the elements are closely similar to those seen in FIGS. 2, 3 and 6, and corresponding elements bear the same numbers. Note, however, that the arcuate lengths of the pusher and receptacles are reduced, so that less sugar, cream, etc., is contained by each pair of pusher-receptacle elements. Also, an additional two pairs of such elements are provided—see pushers 121 and 122, for example.

FIGS. 29 and 30 indicate that the added pusher and receptacle 122 and 122*a* are the same in cross section as the pusher and receptacle elements, as seen in FIGS. 3 and 6, and are openable in the same manner.

FIG. 31 shows the close spacing of successive pusher and receptacle elements.

The above cups, caps, sticks, etc., can be made of recyclable material, such as PVC, polystyrene, or oriented polystyrene (OPS), each being of food grade, FDA approved.

Figure 5:
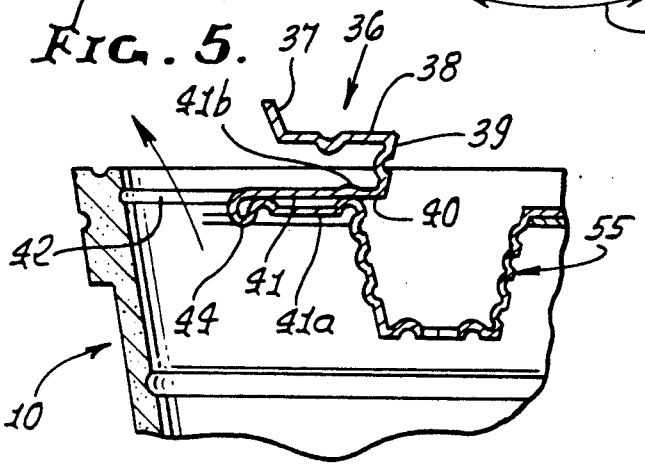
FIG. 5 is a fragmentary view like FIG. 4 showing a drinking zone of the dispenser top in opened condition.

In FIG. 5, the cover sections 41 and 41*a* may snap together at 41*b*. In FIG. 4, the lowermost wall portion of receptacle 55 may contain one or more through openings, as at 55*c*, to pass air or water vapor to the exterior. The lids may also contain such openings.

In FIG. 14, the opening at 134 can take the form of opening 49*a* in FIG. 8. In FIG. 3, the sugar and cream contents 30 and 31 can partly fill the spaces between the pushers and receptacles, instead of completely filling them.

In FIG. 12, the mixing stick 59 may contain coffee or tea in one end portion, and sugar in the opposite end portion, so that a user can selectively dip either end of the stick into hot water, to dispense the desired amount of these substances into the hot water in a cup.

Figure 12A:
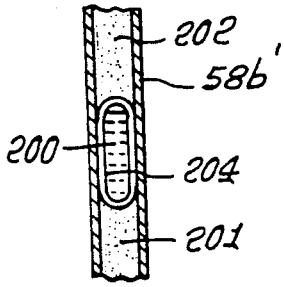

Also, cream 200 can be encapsulated between the coffee (or tea) 201 and the sugar 202, as per FIG. 12*a*, and the user can optionally break the stick at that point and pour the cream into the cup. The structure shown in fragmentary FIG. 12*a* is meant to embody these features. See frangible capsule 204, for cream, in the intermediate portion of the stick 58*b*', which is like stick 58*b*.

I claim:

1. In a dispenser for dispensing dispensable substance or substances, the combination comprising a) carrier structure, b) elongated pusher structure on the carrier structure, c) elongated receptacle structure beneath the pusher structure and on the carrier structure, there being an elongated zone or zones between the pusher structure and receptacle structure to receive the dispensable substance or substances, d) the pusher structure being selectively manually deflectable toward the receptacle structure, at selected locations along the length of the pusher structure length, e) the receptacle structure being frangible at selected lengthwise locations corresponding to said selected locations along the length of the pusher structure, and in response to deflection of the pusher structure, f) whereby dispensing of the dispensable substance or substances occurs at said selected lengthwise locations of the receptacle structure, g) the pusher structure including at least one elongated pusher having a length which is at least about three times its width, and having arching extent over its width so as to project upwardly from the carrier structure, and including a deflector integral with said arching extent to project downwardly in said arching extent toward the receptacle structure, along the elongated length of the pusher, whereby a user can progressively run his finger lengthwise along the pusher to deflect the pusher variably along its length and to an extent corresponding to the amount of dispensable substance to be dispensed from the receptacle structure in response to deflector engagement with and opening of the receptacle structure.

2. The combination of claim 1 wherein said carrier structure comprises a lid for a container.

3. The combination of claim 2 including a zone on the lid adapted to be opened to define a drinking access means, for passing liquid through the lid on the container.

4. The combination of claim 3 including a peripheral bead on the lid to interfit a rim on the container, the pusher structure extending lengthwise generally parallel to the head.

5. The combination of claim 3 including a flap integral with the lid, and which is liftable to define said access means.

6. The combination of claim 3 wherein said zone on the lid forms a local dome spaced from said pusher structure.

7. The combination of claim 2 including said container, and further means whereby a mixing stick may be inserted through the lid and into liquid in the container, and whereby the stick may be oscillated to mix liquid in the container.

8. The combination of claim 7 wherein said further means includes a central portion of said lid forming a flexible receptacle having a central opening to pass said mixing stick.

9. The combination of claim 7 including said mixing stick which is tubular and contains a substance to be dispensed into liquid in the container.

10. The combination of claim 2 wherein said pusher structure and receptacle structure are on a dome portion of the carrier structure that projects upwardly from a plane defined by the lid, said dome portion being hollow to pass the dispensable substance or substances downwardly from the selected portions of the receptacle structure.

11. The combination of claim 10 including said container and wherein said carrier structure includes additional upper and lower carrier sheets extending horizontally in adjacent relation to form the lid, one additional carrier sheet carrying said dome portion of the carrier, and the other additional carrier sheet connectible to the container, the sheets having registrable openings therein, and the upper additional sheet rotatable relative to the lower additional sheet to selectively register the openings.

12. The combination of claim 10 wherein said portion also forms a drinking access zone.

13. The combination of claim 2 wherein said pusher structure extends lengthwise arcuately on the lid.

14. The combination of claim 13 wherein said pusher structure comprises a group of elongated pushers as defined, and said receptacle structure comprises a group of elongated receptacles, each receptacle extending lengthwise beneath a pusher.

15. The combination of claim 14 wherein there are multiple deflectors as defined integral with the pushers and projecting downwardly toward the receptacles to deflect and open the receptacles in response to downward displacement of the pushers, at locations immediately below the extents of the elongated pushers that are displaced downwardly said deflectors being elongated in the length directions of the pushers.

16. The combination of claim 14 including said dispensable substances, one of which is cream associated with one or more first receptacles, and another of which is sugar associated with one or more second receptacles.

17. The combination of claim 14 including said dispensable substance, which consists of salad dressing.

18. The combination of claim 17 including a container which is a tray and said pusher and receptacle extend linearly and in rows on said lid for the tray.

19. The combination of claim 18 wherein said lid is peripherally supported on the container.

20. The combination of claim 14 including said dispensable substances, one of which is mustard associated with a first receptacle or receptacles, and another of which is catsup associated with a second receptacle or receptacles, said lid adapted to be carried by a hot dog container.

21. The container of claim 20 including said hot dog container on which said lid is mounted.

22. The combination of claim 21 including a support cord attached to said container.

23. The combination of claim 14 including said dispensable substance which comprises ice cream or yogurt topping, the lid adapted to be carried by an ice cream or yogurt container.

24. The combination of claim 1 wherein the carrier structure includes $x_1$) a first carrier for the pusher structure $x_2$) a second carrier for the receptacle structure said first and second carriers interconnected to define a lid for a container.

* * * * *